US011448422B2

(12) United States Patent
De Gea et al.

(10) Patent No.: US 11,448,422 B2
(45) Date of Patent: Sep. 20, 2022

(54) CONDENSATE LIFTING DEVICE COMPRISING A MOVABLE CONDENSATE RECEIVING TANK, OR MOUNTED ON A SUPPORT MOVABLE IN TRANSLATION AND/OR ROTATION

(71) Applicant: SAUERMANN INDUSTRIE, Chevry-Cossigny (FR)

(72) Inventors: Olivier De Gea, Saint Vrain (FR); François Sardet, Combs-la-Ville (FR); Laurent Guillard, Meaux (FR)

(73) Assignee: SAUERMANN INDUSTRIE, Chevry-Cossigny (FR)

( * ) Notice: Subject to any disclaimer, the term of this patent is extended or adjusted under 35 U.S.C. 154(b) by 139 days.

(21) Appl. No.: 17/251,030

(22) PCT Filed: Jul. 26, 2019

(86) PCT No.: PCT/EP2019/070230

§ 371 (c)(1),
(2) Date: Dec. 10, 2020

(87) PCT Pub. No.: WO2020/025491

PCT Pub. Date: Feb. 6, 2020

(65) Prior Publication Data

US 2021/0172649 A1 Jun. 10, 2021

(30) Foreign Application Priority Data

Aug. 3, 2018 (FR) ..... 1857310

(51) Int. Cl.
*F24F 13/00* (2006.01)
*F24F 13/22* (2006.01)

(52) U.S. Cl.
CPC ..... *F24F 13/222* (2013.01); *F24F 2013/227* (2013.01)

(58) Field of Classification Search
CPC ..... F24F 13/222; F24F 2013/227
See application file for complete search history.

(56) References Cited

U.S. PATENT DOCUMENTS 7,578,932 B2 * 8/2009 Cantolino ..... F25D 21/14 210/232
8,028,536 B2 * 10/2011 Morgan ..... F24F 13/222 62/272

(Continued)

FOREIGN PATENT DOCUMENTS

CN 103727646 A 4/2014
EP 2141721 A2 1/2010

(Continued)

OTHER PUBLICATIONS

Chinese Office Action including search report dated Oct. 15, 2021 for corresponding Chinese Application No. 201980044098.1.

(Continued)

*Primary Examiner* — Filip Zec
(74) *Attorney, Agent, or Firm* — David D. Brush; Westman, Champlin & Koehler, P.A.

(57) ABSTRACT

A condensate lifting device, including: a condensate receiving tank and a pump for lifting the condensates received in the tank. The pump is mounted on a first support for holding and/or guiding the tank or a second support carrying the tank, so that the tank or the second support is movable, in translation and/or in rotation, relative to the first support, so as to be able to take at least two positions: a working position, wherein the tank is connected to the pump; and a drainage position, wherein the tank is disconnected from the pump and displaced relative to the first support, so as to allow an operation of cleaning and/or draining the condensates.

10 Claims, 6 Drawing Sheets

(56) References Cited

U.S. PATENT DOCUMENTS

| | | | | |
|---|---|---|---|---|
| 8,151,592 | B2 | 4/2012 | Badia et al. | |
| 8,397,525 | B2 | 3/2013 | Chauvin et al. | |
| 8,651,824 | B2 * | 2/2014 | Ward | F24F 13/22 417/36 |
| 10,712,044 | B1 * | 7/2020 | Des Champs | F24F 13/222 |
| 2009/0084127 | A1 * | 4/2009 | Nakata | F24F 1/0063 62/291 |
| 2010/0064705 | A1 | 3/2010 | Chauvin et al. | |
| 2010/0089086 | A1 | 4/2010 | Badia et al. | |
| 2011/0272043 | A1 | 11/2011 | Hollingsworth et al. | |
| 2014/0130529 | A1 | 5/2014 | Kaiser et al. | |

FOREIGN PATENT DOCUMENTS

| | | | |
|---|---|---|---|
| EP | 2166317 | A1 | 3/2010 |
| FR | 2786852 | A1 | 6/2000 |
| WO | 2011130631 | A2 | 10/2011 |
| WO | 2014156542 | A1 | 10/2014 |

OTHER PUBLICATIONS

English translation of the Written Opinion of the International Searching Authority dated Oct. 23, 2019 for corresponding International Application No. PCT/EP2019/070230, filed Jul. 26, 2019.

French Search Report and Written Opinion dated Jun. 24, 2019 for corresponding French Application No. 1857310, filed Aug. 3, 2018.

International Search Report dated Oct. 17, 2019 for corresponding International Application No. PCT/EP2019/070230, dated Jul. 26, 2019.

Written Opinion of the International Searching Authority dated Oct. 17, 2019 for corresponding International Application No. PCT/EP2019/070230, filed Jul. 26, 2019.

* cited by examiner

CONDENSATE LIFTING DEVICE COMPRISING A MOVABLE CONDENSATE RECEIVING TANK, OR MOUNTED ON A SUPPORT MOVABLE IN TRANSLATION AND/OR ROTATION

CROSS-REFERENCE TO RELATED APPLICATIONS

This Application is a Section 371 National Stage Application of International Application No. PCT/EP2019/070230, filed Jul. 26, 2019, which is incorporated by reference in its entirety and published as WO 2020/025491 A1 on Feb. 6, 2020, not in English.

FIELD

The field of the invention is that of condensate lifting devices, intended to be implemented in systems producing condensates, in particular air conditioning systems, refrigerating systems, ventilation systems or heating systems.

PRIOR ART

In what follows, the focus is more particularly on describing the problem existing in the field of air conditioning systems, with which the inventors of the present patent application were confronted.

However, the invention is not limited to this particular field of application but applies to all systems producing condensates, in particular systems of the "HVAR" (for "Heating, Ventilation, Air-conditioning and/or Refrigeration") type.

In an air conditioning system, the condensates—which result from the condensation of the water vapour present in the ambient air which is cooled—are conventionally recovered in a container, or more generally in a recovery tank, which can in some cases be a simple collection panel.

It is necessary to evacuate the recovered condensates, on the one hand, to prevent the recovery tank from overflowing, and on the other hand, to limit the risks of bacterial contamination related to the stagnation of the condensates in this tank.

This can be done by gravity, for example using a rigid or semi-rigid pipe linked to a wastewater evacuation system, or by pumping the condensates collected in the recovery tank.

The invention applies more particularly to the latter case.

Condensate pumping systems generally implement a hydraulic pump driven—that is to say, started and stopped—by means for detecting the level of condensates present in the tank.

These means for detecting the condensate level can be based on a level sensor, for example a capacitive sensor, configured to be able to measure at least two condensate levels inside the container, corresponding to a first maximum level, at which the pump must be activated in order to evacuate the condensates, and a second minimum level, at which the pump must be stopped.

A third condensate level, called safety level, can be measured, greater than the maximum level, and corresponding to a critical situation, wherein the height of the liquid is abnormally high (for example due to a clogged or out of use pump).

Processing means deliver the required controls to the pump (starting or stopping), depending on the condensate levels detected by the condensate level detection means.

An alarm system can also be provided to warn the user of an abnormally high liquid level in the receiving tank, in particular when the safety level has been reached.

The condensate lifting devices thus comprise a certain number of essential components, that the technician assigned to the installation of the device must put in place one by one, then connect by a plurality of cables and conduits.

In other words, the components of the condensate lifting device are supplied and then installed separately, or independently of each other, which implies the use of a relatively large number of (hydraulic and electrical) connection elements, possible installation difficulties, and risks of malfunction, loss of time and money, . . . .

In addition, it can be difficult for the technician to install some of these components, which must occupy a specific position within the air conditioning system, in areas that are sometimes difficult to access.

This is for example the case with the means for detecting the levels of condensates which must generally be placed in or near the tank, or the lifting pump which must generally be placed inside a channel or an interior architectural element, such as a false ceiling.

In these systems, the condensate lifting pump must be connected to the air conditioner by means of several electric cables, in particular a cable corresponding to the phase, a cable corresponding to the neutral, and an alarm cable, corresponding to the safety level.

The alarm cable sometimes poses installation difficulties for technicians: indeed, it may be difficult to link it to an air conditioner that has not been explicitly designed to cooperate with the considered lifting device.

Improper installation of the alarm system is however detrimental to the correct operation of the condensate lifting device, since there is then a risk that an abnormally high condensate level in the tank is detected, but does not cause stopping the air conditioning, leading to condensate overflowing out of the tank and possibly damaging the lifting device and/or its surroundings.

The maintenance of condensate removal devices can also be problematic, due to the poor accessibility of the various components.

In particular, the state of the condensate lifting pump must be controlled regularly in order to prevent condensate leaks from the tank, due to its fouling or to a breakdown, and the condensate receiving tank must be regularly drained and cleaned to prevent condensate stagnation and the creation of biofilms.

However, the condensate lifting pump and the condensate receiving tank can generally be reached by the maintenance technician only by first dismounting one or more parts of the air conditioner or its surroundings, which involves a consequent loss of time and efficiency.

Finally, over the long term, the reliability of the condensate level detection devices currently used in lifting systems is not always guaranteed, as their positioning can indeed be out of order.

The relative heights of the condensates detected in the tank can thus be falsified and consequently lead to a risk of failure of the condensate lifting device, for example a too late triggering of the pump causing condensate leaks.

There is thus a need for a condensate lifting device which is of simple construction, which is quick to install, which requires little connection, and/or whose reliability is optimised.

There is also a need for a condensate lifting device, whose components are easily and quickly accessible so as to carry out their maintenance on a regular basis, in a preventive and/or curative manner.

SUMMARY

The purpose of the present invention is to overcome at least some of these disadvantages of the prior art, according to the embodiments.

These purposes, as well as others which will not appear below, are achieved using a condensate lifting device, comprising a condensate receiving tank, and a pump for lifting the condensates received in said tank.

According to the invention, the pump is mounted on a first support carrying means for holding and/or guiding said tank or a second support carrying said tank, so that said tank or said second support is movable, in translation and/or in rotation, relative to said first support, so as to be able to take at least two positions:

- a working position, wherein said tank is connected to said pump;
- a drainage position, wherein said tank is disconnected from said pump and displaced relative to said first support, so as to allow an operation of cleaning and/or draining the condensates.

According to a particular aspect of the invention, the condensate lifting device comprises means for detecting at least one predetermined condensate level in said tank, mounted on said first support.

Advantageously, in said working position, said condensate level detection means extend outside said tank, close to the latter.

According to a particular aspect of the invention, said first support is formed by or comprises a printed circuit, carrying said pump and/or means for controlling said pump.

Advantageously, said condensate level detection means implement at least two electrodes deposited directly on said printed circuit.

According to a particular aspect of the invention, said first support carries at least one slide guiding said tank or said second support.

Advantageously, said slide carries a connector receiving a pipe delivering the condensates produced by an HVAR system to which said condensate lifting device is assigned, and directing said condensates towards said tank, at least in said working position.

According to a particular aspect of the invention, said first support is mounted movable in translation and/or in rotation relative to a third support, intended to be stationary relative to an HVAR system to which said condensate lifting device is assigned, so that said first support can take at least two positions: an operating position and a maintenance position.

Advantageously, said third support carries a first electrical connector, bringing an electric current able to cooperate with a second electrical connector carried by said first support, and/or a first hydraulic connector, able to be connected with a second hydraulic connector integral with said pump, said first electrical connector and/or said first hydraulic connector being mounted so that it is disconnected from said second electrical connector and/or from said second hydraulic connector, in said maintenance position.

Advantageously, said first hydraulic connector comprises or cooperates with an anti-syphoning and/or anti-return hydraulic element mounted on said third support.

According to a particular aspect of the invention, said first support or said third support forms a structural element able to hold or participate in the holding of an HVAR system to which said condensate lifting device is assigned.

According to a particular aspect of the invention, said first support or said third support carries power supply means for said HVAC system.

According to a particular aspect of the invention, the condensate lifting device comprises means for cutting off said power supply means when said level detection means detect that an alarm level is reached.

According to a particular aspect of the invention, said tank has an area for receiving condensates, at least one wall of which has a clearance adapted to limit the stagnation of the condensates in said tank.

According to a particular aspect of the invention, the condensate lifting device is housed in a casing having an opening for extracting said movable tank, from said second support and/or from said first support.

Advantageously, said movable tank, said second support and/or said first support carries a cover capable of cooperating with said extraction opening.

According to a particular aspect of the invention, the condensate lifting device is configured to cooperate with a left side or a right side of an HVAR system to which said condensate lifting device is assigned.

According to various implementations, said casing is, or comprises:

- a channel, or
- an interior architectural element associated with said refrigerating system, or
- a casing of said refrigerating system.

According to a particular aspect of the invention, the condensate lifting device comprises means for indicating a need to drain said condensate receiving tank and/or to maintain said lifting device.

According to one particular aspect of the invention, the condensate lifting device comprises a mechanism for triggering an at least partial extraction or reinsertion of said movable tank or of the second support, relative to said first support, and/or of said first support, relative to said third support.

LIST OF THE FIGURES

Other features and advantages of the invention will emerge more clearly upon reading the following description, given by way of illustrative and non-limiting example, with regard to the appended drawings, among which:

FIG. 1 schematically illustrates a condensate lifting device according to one embodiment of the invention;

FIG. 2 shows the condensate lifting device of FIG. 1, integrated into an air conditioner;

FIG. 3 schematically shows the three sub-assemblies of the condensate device of FIG. 1, separated from each other, namely the tank, displaced relative to a pump support carrying the printed circuit equipped with the condensate lifting pump, in turn displaced relative to a base support;

Figure 8:
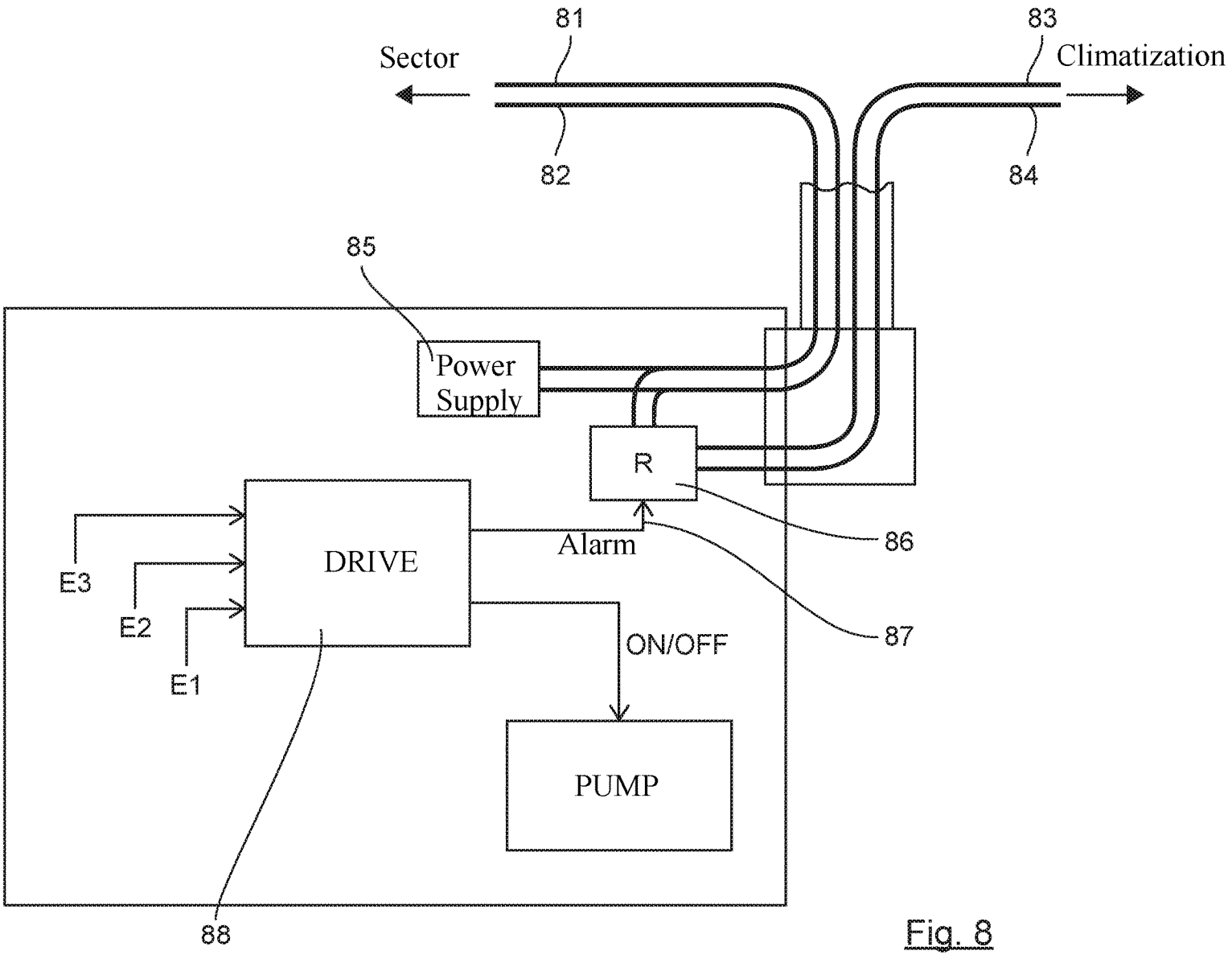

FIG. 8 schematically illustrates the wiring of the power supply of the lifting device and of the air conditioner, simplifying the management of alarm situations.

DETAILED DESCRIPTION 5.0 General Principle

The invention provides a new approach to the architecture of a condensate lifting device, allowing to simplify the manufacturing, installation and maintenance operations of the device.

5.0.1 Preventive Maintenance: Access to the Tank

The condensate lifting device comprises in particular a condensate receiving tank which must be subjected to a regular control aiming at preventing any stagnation of the condensates which could cause the formation of biofilm, aqueous and gelatinous matrix secreted by bacteria in the liquid, and which promotes bacterial proliferation.

The condensate receiving tank must therefore be easily accessible so that it can be drained and cleaned regularly, in order to eliminate the condensate which would not have been evacuated by the condensate lifting pump.

For this purpose, the condensate receiving tank is movable in translation and/or in rotation relative to a pump support, or first support, carrying a pump intended for lifting the condensates recovered in the tank.

Alternatively, the condensate receiving tank can be carried by a tank support, or second support, movable in translation and/or in rotation relative to the pump support. In other words, the tank can be a one-piece moulded element, for example made of plastic material, or an element integral with a support.

The condensate receiving tank, or the tank support on which it is mounted, can thus take two distinct positions:

- a first position called "working position" wherein the tank is connected to the pump, so that the pump can extract the condensates from the tank;
- a second position called "drainage position" wherein the tank is disconnected from the pump and extracted from the pump support, or at the very least displaced relative to the latter, so as to allow a cleaning and/or condensate drainage operation.

It is thus possible to easily carry out regular cleaning of the condensate receiving tank, by displacing and/or extracting the latter or the first sub-assembly on which it is mounted, without the need to dismount any part of the air conditioner.

5.0.2 Curative Maintenance: Access to the Pump and the Electrical Circuit

According to another aspect of the invention, which, according to the embodiments, can be implemented independently or in combination with the above, the support carrying in particular the pump and its drive means can be separated from a base support, to allow intervention on its components. The base support carries elements of electrical connection (power supply and connection to the air conditioner) and hydraulic connection to the pump, which can be separated by displacing the pump support.

The base support can be adapted to participate in the placement, mounting and/or holding of the air conditioner.

5.0.3 Safety: Stopping the Air Conditioning in the Event of a Failure

According to another aspect of the invention, which, according to the embodiments, can be implemented independently or in combination with the above, the electrical means of the pump support directly controls the power supply to the air conditioner. Thus, the mains is received in the electrical means, then redirected to the air conditioner. In the event of a failure identified, typically when the safety level is reached, the electrical means act directly on a relay, cutting the power supply to the air conditioner, without it being necessary for the latter to receive an alarm signal or to process it in a special way.

5.1 Example of Implementation 5.1.1 Mounting Relative to an Air Conditioner

Figure 1:
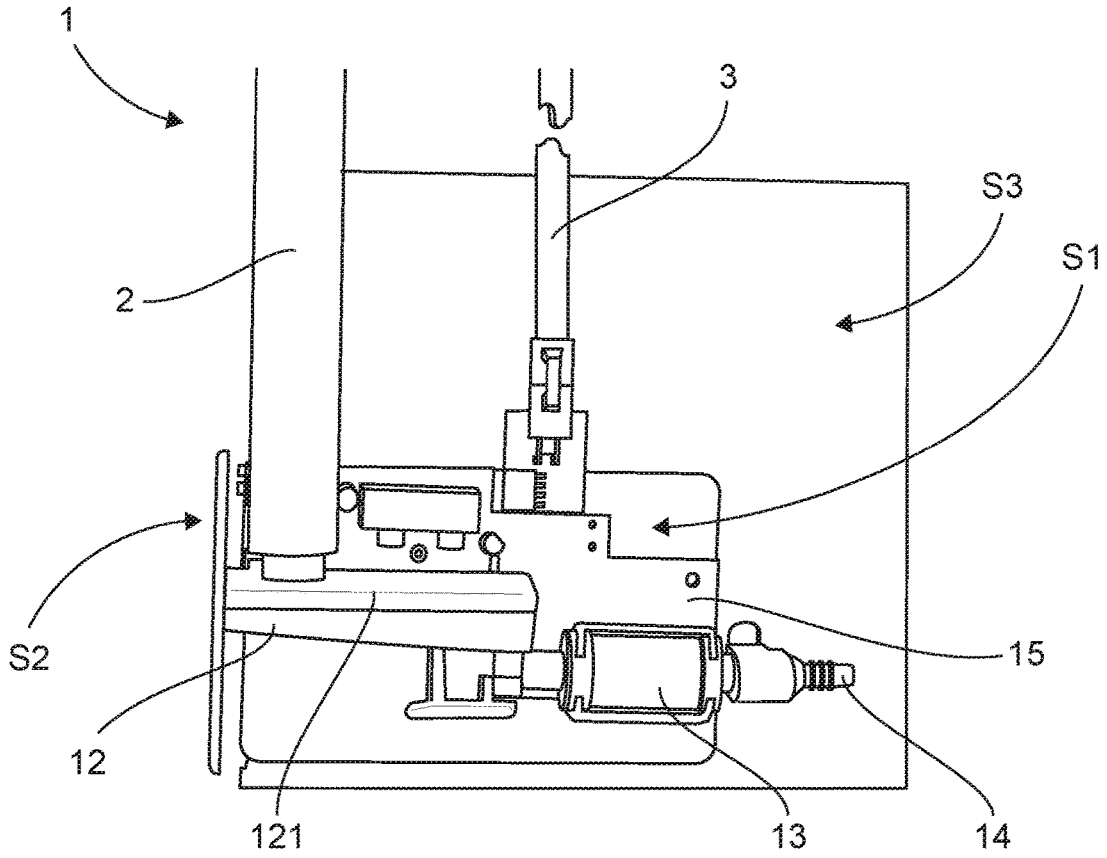

FIG. 1 schematically shows a condensate lifting device 1 according to one embodiment of the invention.

Figure 2:
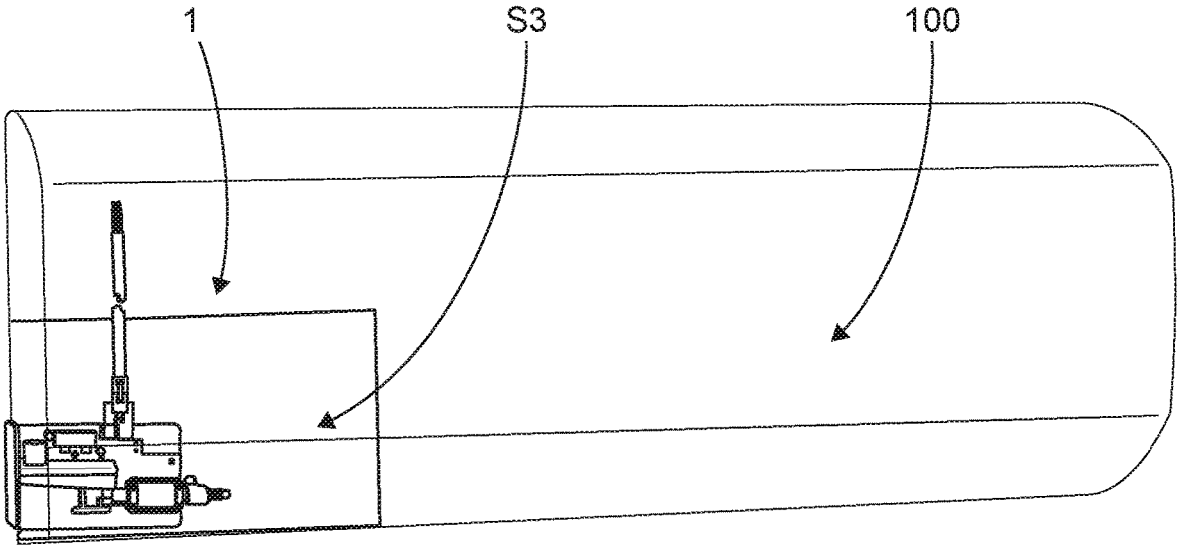

As can be seen in FIG. 2, the condensate lifting device 1 can be integrated into the casing of a wall-mounted air conditioner 100. In this case, it can correspond to an angle of the air conditioner, and participate in the mounting and/or in the holding thereof. Special means, guides, polarisers and/or fastening means can thus be provided, to cooperate with the air conditioner (and more generally the system cooperating with the condensate lifting device).

5.1.2 Principle of Operation

However, the condensate lifting device 1 could also be placed in a channel or in an interior architectural element, decorative or not, placed outside the air conditioner 100 and connected thereto by known means.

The condensate lifting device 1 is intended to recover droplets of liquid—called condensates—resulting from the condensation of hot air entering the air conditioner, and then evacuate them.

For this purpose, the condensate lifting device 1 comprises a certain number of essential components, the operation of which is presented below.

A pipe 2 guides the condensation droplets towards a condensate receiving tank 12. It is here connected to a cover 121 extending above the tank 12.

The pipe 2 is preferably mounted vertically, so as to limit the stagnation of the condensates within the pipe, and thus limit the formation of biofilm.

5.1.3 Tank

For the same reason, provision is also made for the internal surface of the condensate recovery tank 12 to include a bottom inclined at an angle $\alpha$, visible in FIG. 5, allowing to direct the condensate towards a recovery area 122 of the tank 12, lower than the droplet fall area.

This angle $\alpha$ can for example be comprised between 2 and 15.

5.1.4 Pump

The condensates recovered at the recovery area 122 of the tank 12 are sucked under the action of a hydraulic pump 13 (for example of the piston, centrifugal, peristaltic, membrane pump type, etc.), then evacuated towards a dedicated circuit (not shown).

An anti-syphoning and/or anti-return element 14 is provided at the outlet of the pump 13 and allows to prevent any backflow of the condensate by syphon effect towards the condensate receiving tank 12.

5.1.5 Pump Drive

Figure 4:
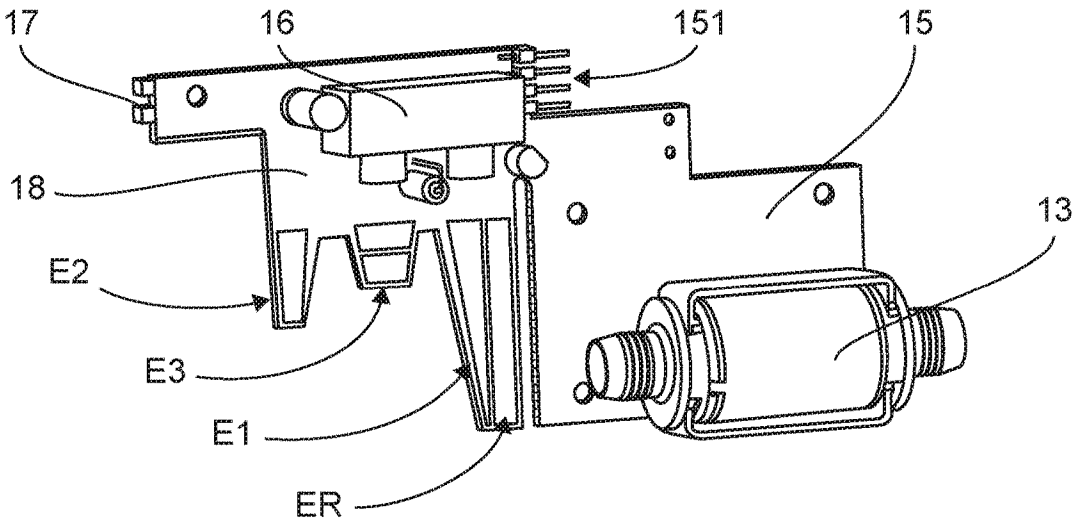
FIG. 4 shows the printed circuit of FIG. 3, carrying in particular the condensate lifting pump, the electrodes of the condensate level detector, the alarm system, and a control panel.

The starting and stopping of the pump 13 are controlled by a system for detecting the condensate level inside the tank 12, comprising a capacitive sensor including three electrodes E1, E2, E3, illustrated in FIG. 4.

Other types of sensors can of course be implemented, inside or outside the tank. It is an advantage of the capacitive sensor to be able to place the electrodes outside the tank, along one of its walls. Another advantage is that these electrodes can be formed directly on the printed circuit carrying in particular the elements for driving the pump, in the form of a deposition of a track made of copper or of a similar conductive material, taking the desired shape and size for each electrode.

The electrodes E1, E2 and E3 allow to measure a capacitance, relative to a reference electrode ER. The measured capacitance Ci varies according to the liquid level inside the condensate receiving tank 12.

The first electrode E1 is called "first level" electrode and allows to create a capacitance C1; the second electrode E2 is called "second level" electrode and allows to create a capacitance C2; and the third electrode E3 is called "alarm level" electrode and allows to create a capacitance C3.

The electrodes E1, E2, E3 each have a different length, or height, which substantially corresponds to a specific condensate level inside the tank 12.

Thus, the "first level" electrode E1 is the longest of the electrodes, such that its lower end corresponds to a minimum condensate level, that is to say the level at which the pump 13 must be stopped.

The "second level" electrode E2 has a length such that its lower end corresponds to a maximum permitted condensate level, that is to say the level at which the pump 13 should be started.

Thus, the pump 13 is turned on when the condensate level is located between the electrodes E1 and E2.

Finally, the "alarm level" electrode E3 is the shortest of the electrodes, so that its lower end corresponds to a critical condensate level in the receiving tank 12, at which an alarm should be generated in order to inform the user of an abnormal situation and/or stop the operation of the air conditioner. The alarm, corresponding to a critical liquid level, is generated by an alarm system 16.

The number of electrodes can be more or less high, so as to double the measurements and/or detect intermediate liquid levels.

The electrodes E1, E2, E3 and ER are intended to be placed preferably outside the condensate receiving tank 12, near one of its side walls, but could also be positioned inside the tank according to some embodiments of the invention.

5.2 Structure in "Fitted" Supports

Figure 3:
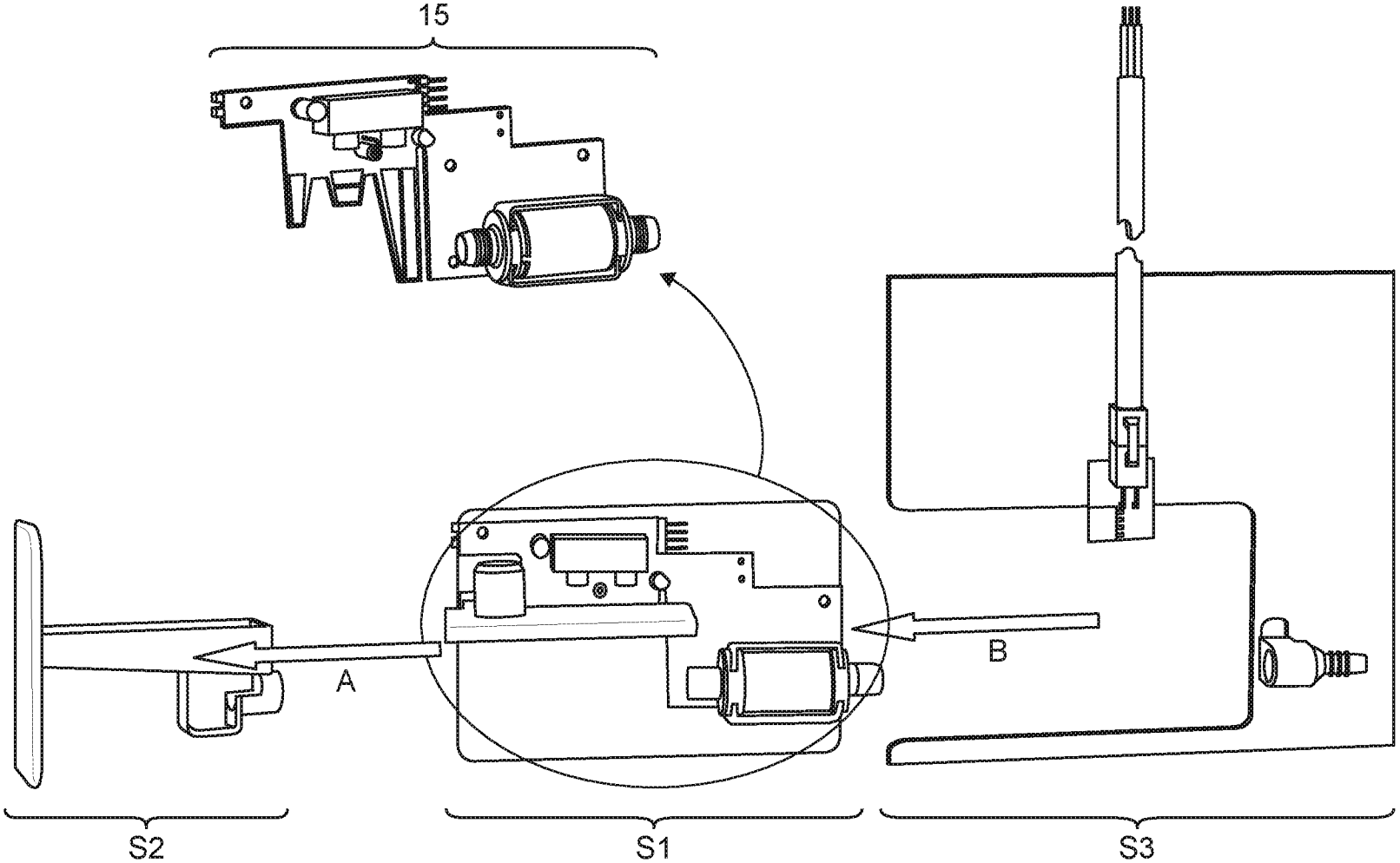

The components of the condensate lifting device 1 are grouped together on three supports S1, S2, S3, or sub-assemblies, of the device, described in relation to FIG. 3.

5.2.1 S1: Pump Support

The first support S1, or pump support, carries the condensate lifting pump 13. More specifically, the first support S1 carries a printed circuit 15 which groups together most of the components, including the pump 13. The first support S1 can also be formed by the printed circuit 15 itself.

The printed circuit 15, illustrated in FIG. 4, groups together at least:

- the electrodes E1, E2, E3, formed directly on the printed circuit 15 by cutting the latter and by depositing copper tracks on the surface of the cut-outs,
- the drive and alarm system 16,
- the condensate lifting pump 13, Additionally, it can also carry a control panel 17 including for example light-emitting diodes (LEDS) allowing to indicate the state of the condensate lifting device 1 (in operation, defective, requiring a drainage, etc.), a USB plug or the like, to access a memory of the system 16, which can store a drive program that can be updated and/or monitoring data intended for maintenance (number of activations of the pump, amount of condensate processed, operating time, time since the last drainage and/or maintenance, alarm situations, etc.) and/or control means 18 (turning on the device, switching to a particular mode, for example maintenance, test, . . . ).

The fact of grouping all these components on the printed circuit 15 allows to obtain a compact assembly, simple to manufacture, and avoiding the technician having to resort to a plurality of connections between these components.

5.2.2 S2: Tank Support

The second support S2, or tank support, carries the condensate receiving tank 12.

In the embodiment illustrated in FIG. 3, the second support S2 is formed by the condensate receiving tank 12 itself, described in more detail below.

5.2.3 S3: Base Support

The third support S3, or base support, is stationary relative to the air conditioner, one of its faces being able to be integral with a receiving surface (for example a house wall).

In a particular embodiment, it can be configured to allow mounting on both the left (FIG. 2) and the right of the air conditioner, to adapt more easily to different mounting conditions. In other embodiments, two versions of the lifting device can be provided, adapted respectively for a mounting on the left and a mounting on the right.

The other face carries an anti-syphoning and/or anti-return element 14, designed to cooperate with the outlet 131 of the pump 13, and the electric cable 3 intended to be connected to the printed circuit 15.

The third support S3 forms a structural element able to hold or participate in the holding of the wall-mounted air conditioner 100, as illustrated in FIG. 2.

5.2.4 Mobility

The pump support S1, and the tank support S2, are configured to be movable relative to the third support S3 so that they can be extracted from the air conditioner by a technician, to perform both preventive maintenance operations and curative maintenance operations with ease.

More specifically, according to a first aspect of the invention, the tank support S2 carrying the condensate receiving tank 12 (or formed by the condensate receiving tank 12), is removable in translation and/or in rotation relative to the pump support S1 (arrow A).

Figure 5A:
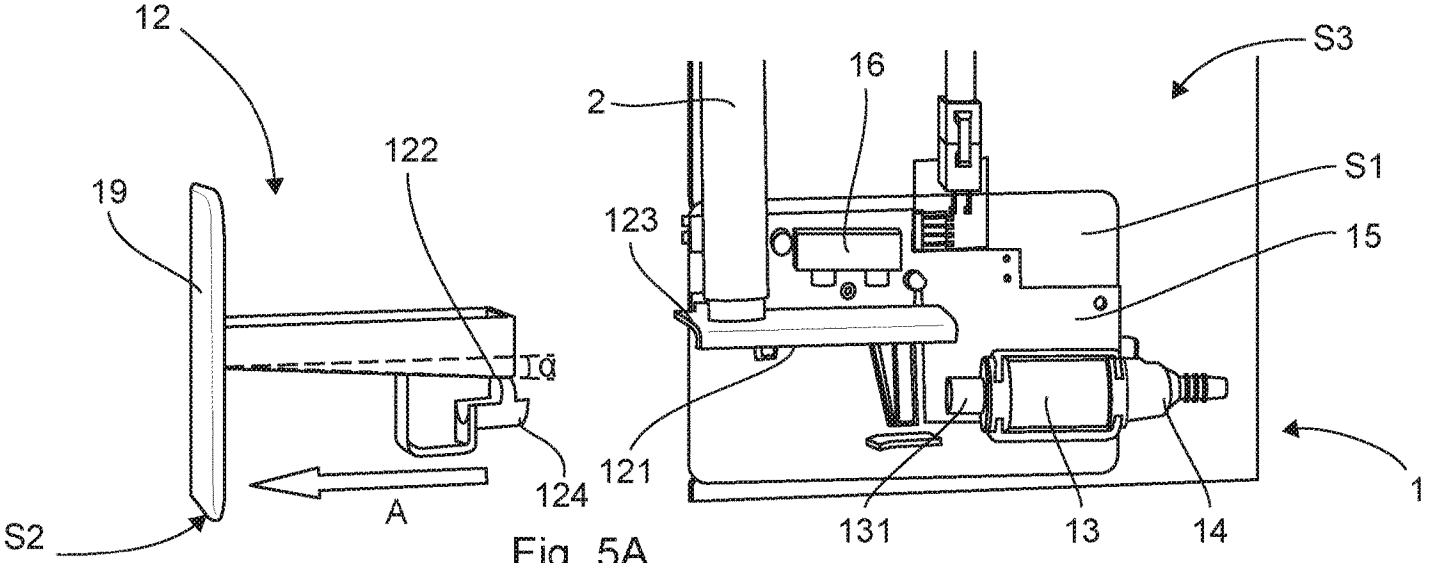
FIG. 5A illustrates the condensate receiving tank of FIG. 3, extracted from the air conditioner so as to allow it to be drained or cleaned, according to an embodiment wherein the tank is movable in translation.
Figure 5C:
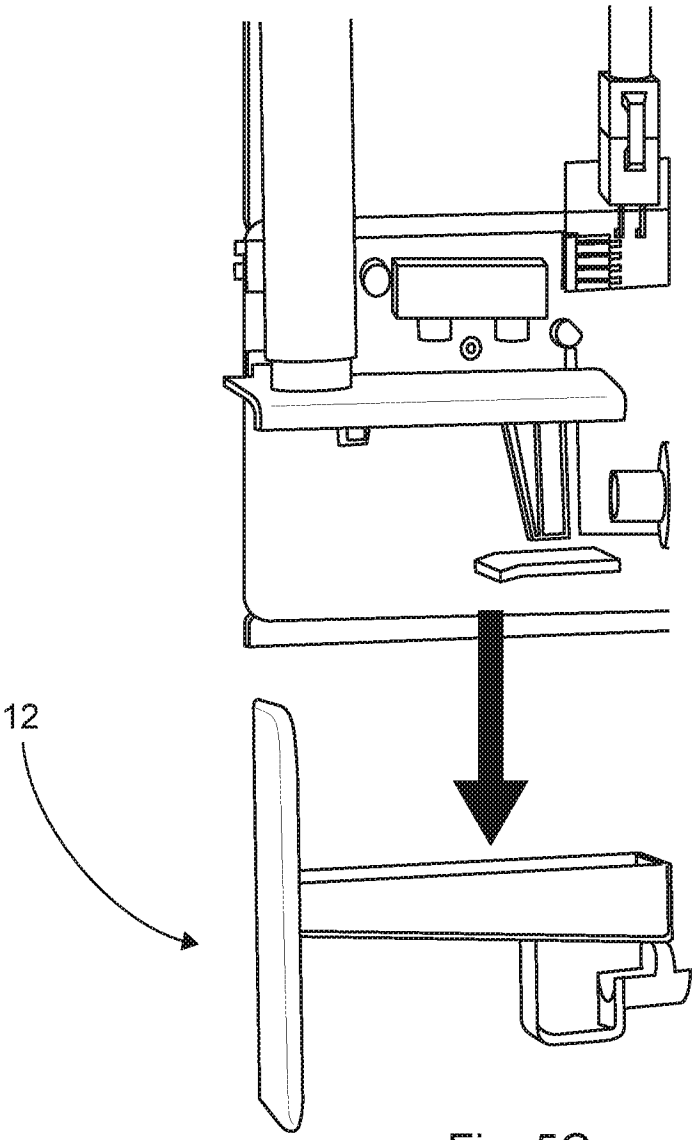
FIGS. 5B and 5C illustrate two variants of mounting and displacement of the tank.
Figure 5B:
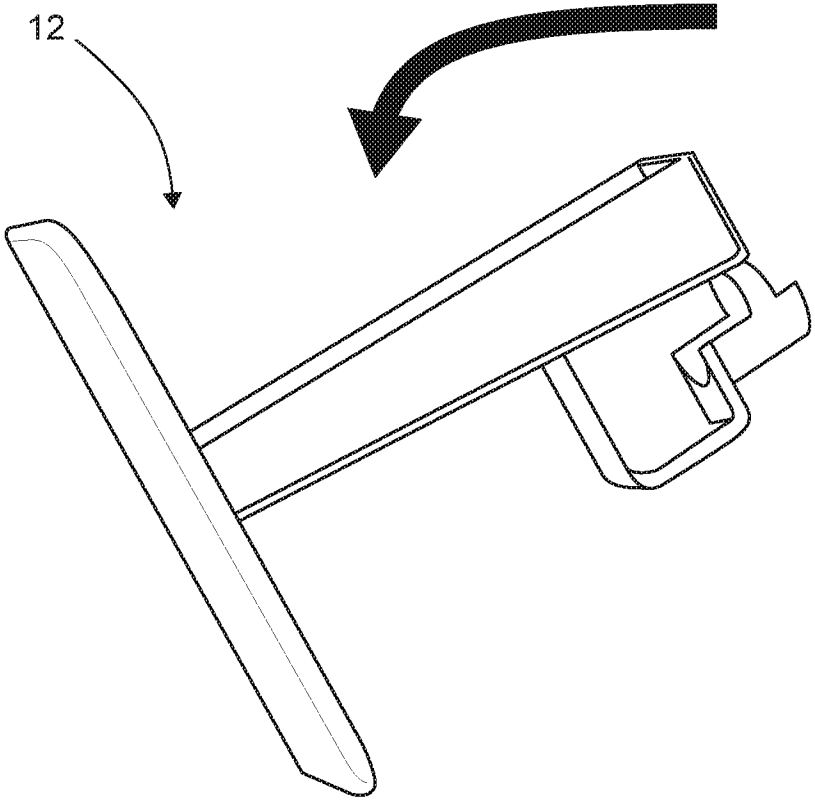

This aspect is the object of paragraph 5.3 and refers in particular to FIGS. 5A to 5C.

According to a second aspect of the invention, the pump support S1, carrying the printed circuit 15 provided with the pump 13 (or formed by the printed circuit 15 provided with the pump 13), is removable in translation and/or in rotation relative to the base support S3 (arrow B).

Figure 6:
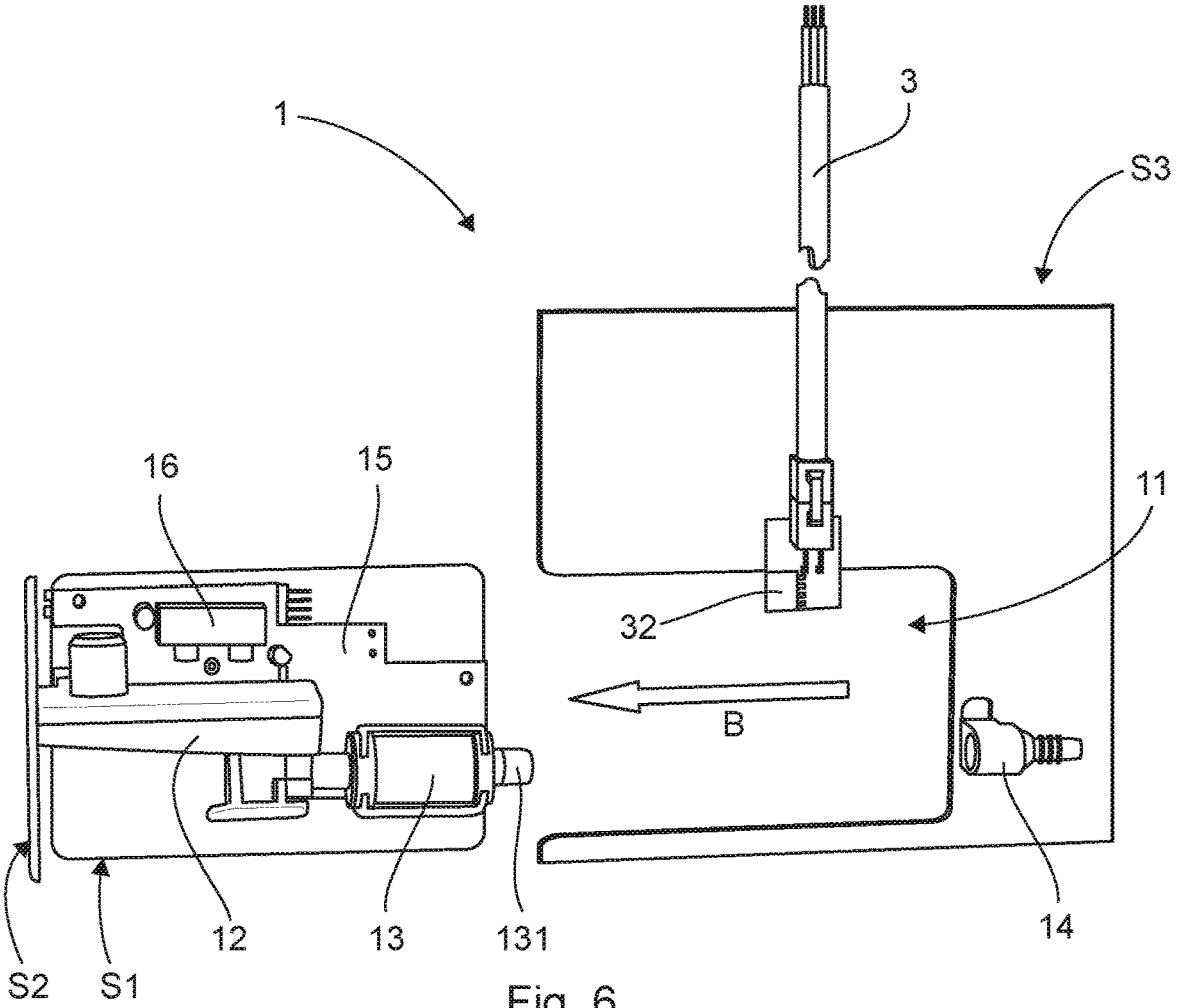
FIG. 6 illustrates the first support comprising the printed circuit equipped with the condensate lifting pump, extracted from the air conditioner.

This aspect is the object of paragraph 5.4 and refers in particular to FIG. 6.

Thus, according to the embodiment illustrated in FIG. 3, the condensate lifting device 1 implements a "double drawer" system: the first "drawer" corresponds to the tank support S2, removable from the pump support S1 and the second "drawer" corresponds to the pump support S1 removable from the base support S3.

A mechanism can be provided to trigger the extraction of the tank support S2 (or the tank 12) and/or the pump support S1 from the air conditioner 100, and/or their at least partial reinsertion into the air conditioner 100.

For example, such a mechanism can implement a spring which allows, in response to pressing on an actuator or the plate, or cover, 19, to cause an unlocking and a displacement of the tank support S2 relative to the air conditioner, by applying pressure to the outer surface of the support. A similar approach can be applied for the pump support S1.

In the illustrated embodiment, the cover 19 is intended in particular to conceal an opening of the air conditioner 100 through which the supports S1 and S2 displace. It can also carry interface elements.

Figure 7:
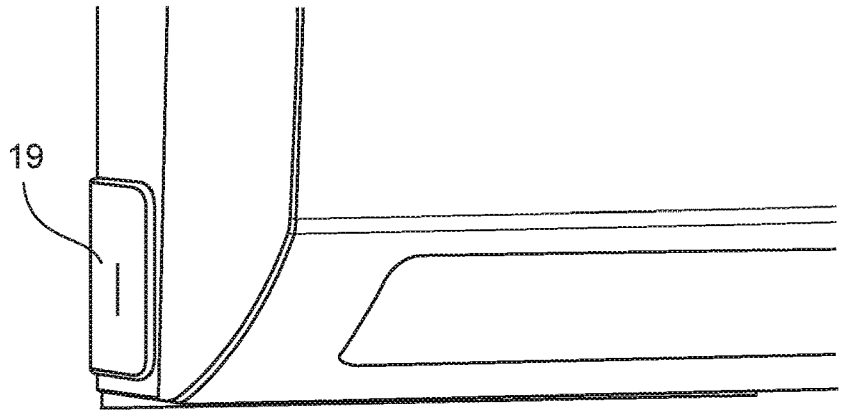
FIG. 7 is a view of the outer surface of the air conditioner, and more specifically of a cover allowing access to the condensate receiving tank and/or to the pump support to be concealed.

This aspect is the object of paragraph 5.4 and refers in particular to FIG. 7.

The features that are the object of each of paragraphs 5.3, to 5.6 below can be implemented jointly or separately, according to the embodiments.

5.3 Removability of the Tank Support Carrying or Forming the Condensate Receiving Tank According to a first aspect of the invention, illustrated in FIG. 5A, the condensate receiving tank 12 is removable from the first support S1, or pump support.

The condensate receiving tank 12 can thus be displaced relative to the pump support S1 and take two distinct positions:

- a position called "working position", or functional position, wherein the tank 12 is housed in the support S1 (in turn housed in the air conditioner 100) and connected to the pump 13 of the support S1 and so as to allow the condensate evacuation, and
- a position called "drainage position", or cleaning position, wherein the tank 12 is extracted from the support S1 (and therefore from the air conditioner 100) and disconnected from the pump, so as to allow a condensate cleaning and/or draining operation.

In the context of a condensate cleaning or draining operation, the pump support S1 and the base support S3 form a single assembly, stationary relative to the air conditioner 100, relative to which the condensate receiving tank 12 can be displaced. In other words, the condensate receiving tank 12 is removable from the sub-assembly formed by the pump support S1 and the base support S3.

According to a variant not illustrated, the condensate receiving tank 12 could also be mounted on a tank support S2 (not illustrated), for example a drawer frame, in turn removable from the pump support S1, so as that the tank 12 can take the aforementioned working and drainage positions.

FIG. 5A shows, according to a particular embodiment, the condensate receiving tank 12 extracted from the air conditioner. The condensate receiving tank 12 is extracted from the side of the air conditioner (arrow A) in a horizontal translational movement, like a drawer.

In other implementations, the tank or its support can perform other movements relative to the support S1, and be extracted for example in a tilting movement (angular rotation of the tank), as illustrated in FIG. 5B, or extracted from below the air conditioner, as illustrated in FIG. 5C (approach allowing the implementation of electrodes are located inside the tank 12 for example). Other displacements, combining rotation and translation, or else screwing (quarter turn for example).

The cover 121 of the tank comprises on at least one of its longitudinal sides a rail 122 for guiding at least one upper edge of the condensate receiving tank 12. In variants, the means for guiding and holding the tank or its support may be independent of this cover.

The tank 12 can thus easily be displaced at least partially relative to the cover 121, and out of the air conditioner. It can be provided that displacing the tank out of the working position automatically interrupts the air conditioner, to limit the production of condensate, and/or displaces a valve for obturating the condensate supply.

According to the invention, a user or a maintenance technician can thus easily and quickly drain the condensate receiving tank 12 or control its state, in particular to ensure the absence of biofilm, by simply sliding the condensate receiving tank 12, relative to the pump support S1, outside the condensate lifting device 1.

When the tank 12 is in the working position, that is to say fully inserted into the device, the outlet 124 of the tank 12 fits with the inlet 131 of the condensate lifting pump 13, so that the tank 12 and the pump 13 are in direct connection with one another and that the pump 13 can evacuate the condensates.

No manual action on the connections is therefore necessary.

Moreover, when the tank 12 is in the working position, one of its side walls extends close to the electrodes E1, E2, E3 and ER, preferably less than 5 mm so as to guarantee the correct operation of the condensate level detection system.

In the illustrated example, the electrodes E1, E2, E3 and ER extend outside the condensate receiving tank 12, in the vicinity of a wall of the tank, when the latter is in the working position.

However, the electrodes could extend inside the tank, and for example be in contact with the condensate, the tank then being removable in the lengthwise direction of the electrodes so as not to be in contact with the latter during its displacement. Other types of sensors, known per se, could also be used.

5.4 Removability of the Pump Support Carrying or Formed by the Condensate Lifting Pump According to another aspect of the invention, illustrated in FIG. 6, the pump support S1 is removably mounted, or at the very least mounted movable, relative to the third support S3, or base support.

The pump support S1 can thus be displaced relative to the base support S3 and take two distinct positions:

- a position called "operating position", or functional position, wherein the pump support S1 is housed in the base support S3 (and therefore in the air conditioner 100) and electrical and hydraulic connections are established between the pump support S1 and the base support S3, so as to allow the evacuation of the condensates, and
- a position called "maintenance position", wherein the support S1 is extracted from the support S3 (and therefore from the air conditioner 100) and the electrical and hydraulic connections are interrupted, so as to allow a maintenance operation of the pump or more generally of the components carried by the printed circuit 15.

The pump support S1 takes the shape of a substantially rectangular plate while the base support S3, integral with the air conditioner 100, comprises a receiving cut-out 11 of complementary shape to the pump support S1.

The pump support S1 can slide (arrow B) inside the base support S3 by means of at least one guide rail (not shown), preferably two guide rails.

The extraction of the pump support S1 from the air conditioner 100, can also be carried out by means of other sliding, tilting or rotating movements.

As part of a maintenance operation, the pump support S1 and the tank support S2 (or the tank 12 alone) can form a single removable assembly relative to the air conditioner 100 or be separated from one another.

In other words, the sub-assembly formed by the pump support S1 and the tank support S2 is removable from the base support S3.

The pump support S1 carries the printed circuit 15 (in one embodiment, the support can be formed by the printed circuit itself) which in turn carries the components of the condensate lifting device 1 which are most likely to need to be repaired and/or exchanged by a technician as part of maintenance.

An advantage of such a structure is that it is easy and quick for the technician to extract the pump support S1 from the air conditioner 100, without special tools, by sliding it like a drawer, and to have access to the components in question. No prior electrical or hydraulic disconnection intervention is necessary.

For example, the technician can repair or replace the pump 13 which is liable to foul or breakdown, without the need to dismount the air conditioner.

When the support S1 is in the operating position, that is to say fully inserted into the air conditioner 100, the outlet 131 of the pump 13 is connected to an anti-syphoning or anti-return element 14, establishing a hydraulic connection between the supports S1 and S3, and an electrical connector 151 of the printed circuit 15 is fitted with a complementary connector 32 receiving the end of the electric cable 3, establishing an electrical connection between the supports S1 and S3.

The hydraulic and electrical connections are designed so that the various elements fit together without the technician having to act on the connections. The connection or disconnection displacement thus takes place parallel to the axis of displacement of the support S1.

5.5 Alarm System

As specified in the preceding paragraphs, the condensate lifting pump 13, the sensor and the drive means are carried by the printed circuit 15, in turn mounted on, or forming, the pump support S1.

This configuration provides a significant advantage over the prior art and in particular allows to significantly simplify the installation of the pump 13.

It is therefore no longer necessary to place the pump outside the air conditioner 100, after the latter has been installed, sometimes in areas that are difficult to access (such as a false ceiling or a channel), and to establish hydraulic and electrical connections therewith.

According to another particular aspect of the invention, it is also not necessary to use an alarm cable which has to act on the air conditioner, to stop it, in the event of failure of the lifting device.

Indeed, as illustrated in the diagram of FIG. 8, supplying power to the air conditioner is made via the lifting device, which can directly interrupt this power supply, without the intermediary of an alarm signal, in when needed.

Thus, the risks of defective wiring of the alarm, and a fortiori of malfunction or deterioration of the condensate lifting device, are significantly reduced.

The printed circuit 15 and all the elements which it carries (pump 13, alarm system 16, control panel 17, control 18 etc.) are power supplied by a single power cable 3, which also ensures the power supply of the air conditioner.

In particular, it can be a standard four-stranded cable:

- two strands 81, 82 are linked to the mains, and consequently power supply the lifting device, via means 85 for transforming the necessary current and voltage;
- two strands 83, 84 ensure power supply of the air conditioner, via a relay 86 provided for this purpose on the printed circuit.

The power supply of the air conditioner is therefore received by means of the current received from the mains on strands 81, 82, when the relay 86 is turned on. If a problem is detected, the electronics of the lifting device acts directly on the relay 86, which becomes turned off. The power supply to the air conditioner is thus immediately interrupted.

Thus, the installer only has to connect strands 83, 84 to the air conditioner, without worrying about any strand carrying an alarm signal, and to link strands 81, 82 to the mains.

The drive means 86, which receive the signals representative of the condensate levels corresponding to the electrodes E1, E2 and E3, produce an alarm signal 87 which cuts the relay 86, when the safety level (electrode E3) is reached. They also drive the pump, according to the minimum and maximum levels.

5.6 Cover for Concealing an Air Conditioner Opening

According to another aspect of the invention, a cover 19, for example made of elastomer, is provided to conceal the extraction opening through which the first support S1 and the second support S2 pass during their displacement relative to the third support. S3.

The cover 19 can for example be provided to extend over the external lateral surface of the air conditioner 100. It can be removable, its tilting or its removal allowing access to the tank support S2 (or the tank 12 alone), so as to extract the latter from the air conditioner 100, directly or using an adapted tool, and to be able to perform the draining or cleaning operations of the tank.

The cover 19 can also be adapted to allow access, via its tilting, to an element (not shown) for gripping the pump support S1, so as to extract the latter from the air conditioner 100 and to be able to access all the components in order to carry out maintenance operations.

The cover 19 can also be carried directly by the second support S2 (or tank 12), or the first support S1, so as to obturate the extraction opening when the supports are housed in the air conditioner 100.

This cover 19 allows to prevent dust from entering inside the lifting device 1 and to seal the extraction opening of the air conditioner 100 so as to obtain an aesthetic external surface. It can also carry interface elements (LED diodes, buttons, connectors, etc.).

The invention claimed is:

1. A condensate lifting device, comprising:

a condensate receiving tank; and a pump for lifting the condensates received in said tank, wherein said pump is mounted on a first support for holding and/or guiding said tank or a second support carrying said tank, so that said tank or said second support is movable, in translation and/or in rotation, relative to said first support, so as to be able to take at least two positions:

- a working position, wherein said tank is connected to said pump; and
- a drainage position, wherein said tank is disconnected from said pump and displaced relative to said first support, so as to allow an operation of cleaning and/or draining the condensates.

2. The condensate lifting device according to claim 1, comprising a level detector for detecting at least one predetermined condensate level in said tank, mounted on said first support.

3. The condensate lifting device according to claim 2, wherein, in said working position, said level detector extends outside said tank, close to the tank.

4. The condensate lifting device according to claim 1, wherein said first support is formed by or comprises a printed circuit, carrying said pump and/or a controller for controlling said pump.

5. The condensate lifting device according to claim 3, wherein:

said first support is formed by or comprises a printed circuit, carrying said pump and/or a controller for controlling said pump; and said level detector implements at least two electrodes deposited directly on said printed circuit.

6. The condensate lifting device according to claim 1, wherein said first support carries at least one slide guiding said tank or said second support.

7. The condensate lifting device according to claim 1, wherein said first support is mounted movable in translation and/or in rotation relative to a third support, which is configured to be stationary relative to an HVAR system to which said condensate lifting device is assigned, so that said first support can take at least two positions: an operating position and a maintenance position.

8. The condensate lifting device according to claim 7, wherein said third support carries a first electrical connector, bringing an electric current able to cooperate with a second electrical connector carried by said first support, and/or a first hydraulic connector, able to be connected with a second hydraulic connector integral with said pump, and said first electrical connector and/or said first hydraulic connector is mounted so that it is disconnected from said second electrical connector and/or from said second hydraulic connector, in said maintenance position.

9. The condensate lifting device according to claim 7, wherein said first support or said third support forms a structural element able to hold or participate in the holding of an HVAR system to which said condensate lifting device is assigned.

10. The condensate lifting device according to claim 1, wherein said tank has an area for receiving condensates, at least one wall of which has a clearance adapted to limit the stagnation of the condensates in said tank.

* * * * *